US009604806B2

(12) United States Patent
Okura

(10) Patent No.: US 9,604,806 B2
(45) Date of Patent: Mar. 28, 2017

(54) SHEET SUPPLYING APPARATUS AND IMAGE FORMING APPARATUS INCLUDING THIS

(71) Applicant: KYOCERA Document Solutions Inc., Osaka (JP)

(72) Inventor: Yoshimasa Okura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/143,879

(22) Filed: May 2, 2016

(65) Prior Publication Data

US 2016/0332832 A1 Nov. 17, 2016

(30) Foreign Application Priority Data

May 15, 2015 (JP) ..... 2015-100057

(51) Int. Cl.

| | |
|---|---|
| ***B65H 5/26*** | (2006.01) |
| ***G03G 21/16*** | (2006.01) |
| ***B65H 1/04*** | (2006.01) |
| ***B65H 3/44*** | (2006.01) |
| ***G03G 15/00*** | (2006.01) |

(52) U.S. Cl.

CPC ..... *B65H 5/26* (2013.01); *B65H 1/04* (2013.01); *B65H 3/44* (2013.01); *G03G 15/6514* (2013.01); *G03G 21/1633* (2013.01); *B65H 2402/31* (2013.01)

(58) Field of Classification Search

CPC ... B65H 1/04; B65H 3/44; B65H 5/26; B65H 2402/31; B65H 2405/1111; B65H 2405/1116; B65H 2405/11162

USPC ..... 271/9.09, 162

See application file for complete search history.

(56) References Cited

U.S. PATENT DOCUMENTS

2009/0267283 A1* 10/2009 Mizuguchi ..... B65H 1/04 271/3.14
2013/0011174 A1* 1/2013 Lee ..... G03G 21/1633 399/381
2013/0164064 A1* 6/2013 Matsumoto ..... B65H 1/04 399/361
2015/0344244 A1* 12/2015 Koga ..... B65H 1/04 271/264
2016/0052735 A1* 2/2016 Tahara ..... B65H 1/08 271/9.09
2016/0122140 A1* 5/2016 Furusawa ..... B65H 1/04 271/147

FOREIGN PATENT DOCUMENTS

JP 2002-187645 A 7/2002

* cited by examiner

*Primary Examiner* — David H Bollinger
(74) *Attorney, Agent, or Firm* — Studebaker & Brackett PC

(57) ABSTRACT

A sheet supplying apparatus includes a supply part, a cover, a base tray, an interlock mechanism, and an auxiliary tray. The supply part is provided in the apparatus body. The cover is provided to be turnable between a close position and an open position. The base tray composes a part of a loading surface on which the sheet is loaded, and is movable in a conveyance direction with respect to the cover. The interlock mechanism moves the base tray by interlocking with the cover turning, and moves the base tray by interlocking with the cover turning. The auxiliary tray is displaceable between a storage position and a raising position. An engage part includes a lifting part. The lifting part comes into pressure contact with an engaged part and displaces the auxiliary tray from the storage position to the raising position.

7 Claims, 11 Drawing Sheets

SHEET SUPPLYING APPARATUS AND IMAGE FORMING APPARATUS INCLUDING THIS

INCORPORATION BY REFERENCE

This application is based on and claims the benefit of priority from Japanese Patent application No. 2015-100057 filed on May 15, 2015, the entire contents of which are incorporated herein by reference.

The present disclosure relates to a sheet supplying apparatus preferably applied in a copying machine or a printer or the like and an image forming apparatus including this.

The image forming apparatus such as a copier includes a manual feed tray (sheet supplying apparatus) for setting a non-fixed size sheet besides a sheet feed cassette storing a fixed size sheet.

For instance, The manual feed tray includes a sheet loading plate turnably supported on a side surface of a body of the copier (apparatus body) through a shaft and an auxiliary loading plate to be drawn out rearward from an inside of the sheet loading plate. It is possible to configure a sheet loading surface enabling to load a large size sheet by drawing the auxiliary loading plate out. In a case when the manual feed tray is not used, the manual feed tray is turned centering on the shaft and is stored along the sheet side surface of the apparatus body.

However, it has been difficult to downsize the sheet loading plate of the manual feed tray described above because the sheet loading plate has to be formed so as to include the auxiliary loading plate. Still further, there is a problem that due to the increase in size of the manual feed tray, a storage space provided on the side surface of the apparatus body also increases in size.

The abovementioned problem may be solved by providing a thin auxiliary loading plate slidably on an upper surface of a thin sheet loading plate for example. It is possible to downsize the manual feed tray by minimizing a gap between the sheet loading plate and the auxiliary loading plate. In a case when this auxiliary loading plate is drawn out, a user might have to hook his/her finger on an upper surface of the auxiliary loading plate because the user cannot grasp a front end part of the auxiliary loading plate. However, because the auxiliary loading plate is thin and there is no gap between the sheet loading plate and the auxiliary loading plate, it is difficult to form a part to which the user can hook his/her finger on the auxiliary loading plate. Therefore, the user is unable to smoothly draw out the auxiliary loading plate. That is, such a problem has occurred that it has become difficult to draw out the auxiliary loading plate in return for the downsizing.

SUMMARY

In accordance with an embodiment of the present disclosure, a sheet supplying apparatus includes a supply part, a cover, a base tray, an interlock mechanism, and an auxiliary tray. The supply part is provided in the apparatus body and delivers a sheet. The cover is supported openably on a side surface of the apparatus body through a turning shaft and is provided to be turnable between a close position covering the supply part and an open position exposing the supply part. The base tray is disposed on an upper surface of the cover disposed at the open position, composes a part of a loading surface on which the sheet is loaded, and is movable in a conveyance direction of the sheet with respect to the cover. The interlock mechanism moves the base tray downstream in the conveyance direction by interlocking with the cover turning from the close position to the open position, and moves the base tray upstream in the conveyance direction by interlocking with the cover turning from the open position to the close position. The auxiliary tray is movable in the conveyance direction through an engage part formed so as to be in slidable contact with an engaged part formed on the base tray and is displaceable between a storage position where the auxiliary tray is in contact with or in adjacent to the upper surface of the cover disposed at the close position and a raising position where the auxiliary tray separates from the upper surface of the cover disposed at the open position. Either one of the engage part and the engaged part includes a lifting part. The lifting part comes into pressure contact with another one among the engage part and the engaged part and displaces the auxiliary tray from the storage position to the raising position in a process of moving the base tray downstream in the conveyance direction by the interlock mechanism.

In accordance with an embodiment of the present disclosure, an image forming apparatus includes a sheet supplying apparatus. The sheet supplying apparatus is provided in an apparatus body. The sheet supplying apparatus includes a supply part, a cover, a base tray, an interlock mechanism, and an auxiliary tray. The supply part is provided in the apparatus body and delivers a sheet. The cover is supported openably on a side surface of the apparatus body through a turning shaft and is provided to be turnable between a close position covering the supply part and an open position exposing the supply part. The base tray is disposed on an upper surface of the cover disposed at the open position, composes a part of a loading surface on which the sheet is loaded, and is movable in a conveyance direction of the sheet with respect to the cover. The interlock mechanism moves the base tray downstream in the conveyance direction by interlocking with the cover turning from the close position to the open position, and moves the base tray upstream in the conveyance direction by interlocking with the cover turning from the open position to the close position. The auxiliary tray is movable in the conveyance direction through an engage part formed so as to be in slidable contact with an engaged part formed on the base tray and is displaceable between a storage position where the auxiliary tray is in contact with or in adjacent to the upper surface of the cover disposed at the close position and a raising position where the auxiliary tray separates from the upper surface of the cover disposed at the open position. Either one of the engage part and the engaged part includes a lifting part. The lifting part comes into pressure contact with another one among the engage part and the engaged part and displaces the auxiliary tray from the storage position to the raising position in a process of moving the base tray downstream in the conveyance direction by the interlock mechanism.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

A preferred embodiment of the present disclosure will be described below with reference to the appended drawings. It is noted that the following description will be made by defining a front side of sheet surfaces of FIGS. 2, 7 through 9, and 11 as a left direction and based on directions indicated in each drawing. It is also noted that a term 'conveyance direction' indicates a conveyance direction of a sheet S and a 'width direction' indicates a width direction of the sheet S orthogonal to the conveyance direction. Still further, 'upstream', 'downstream' and similar terms thereof indicate 'upstream', 'downstream', and concepts similar to them in the conveyance direction.

Figure 1:
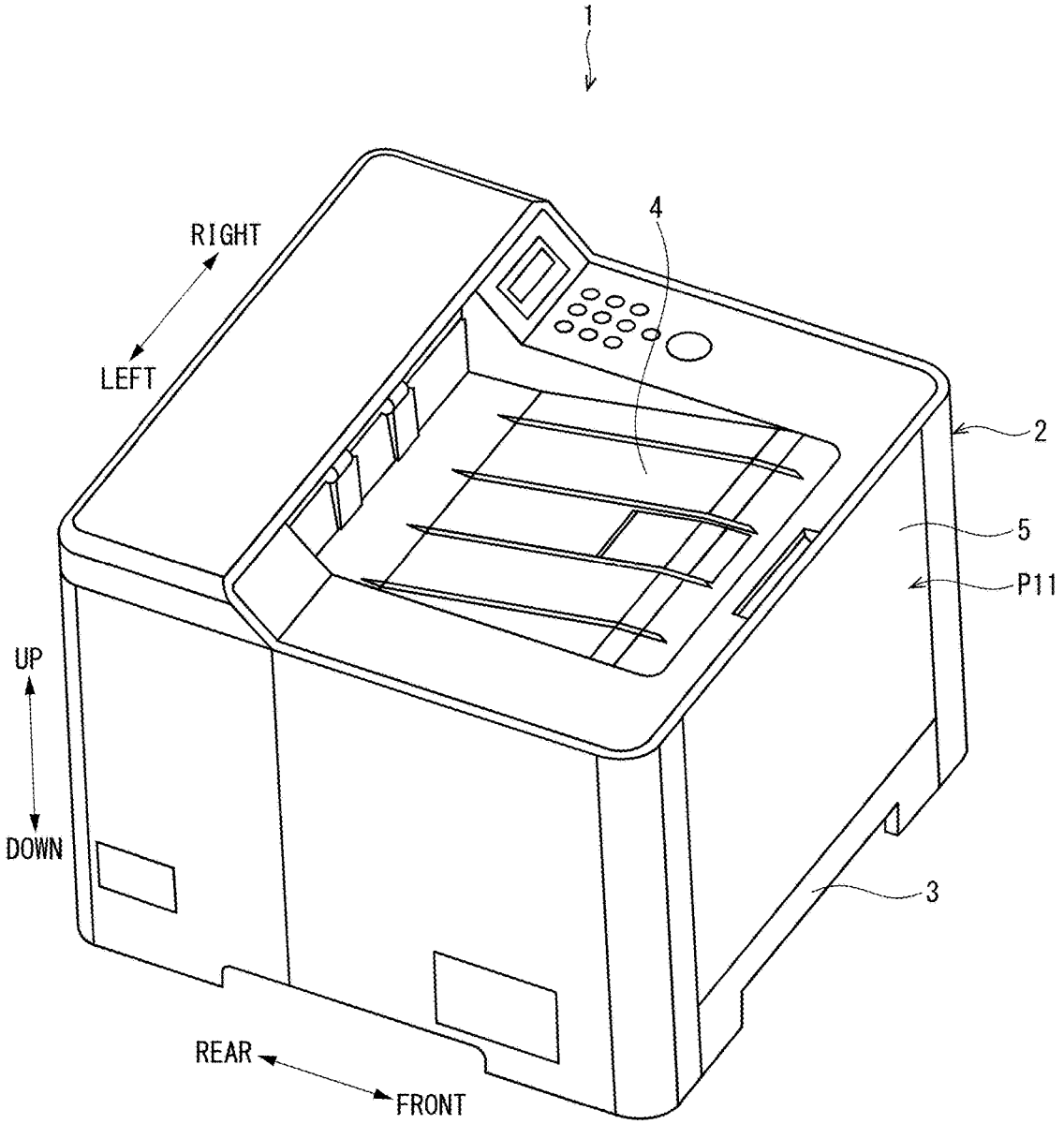
FIG. 1 is a perspective view illustrating a printer of one embodiment of the present disclosure.
Figure 2:
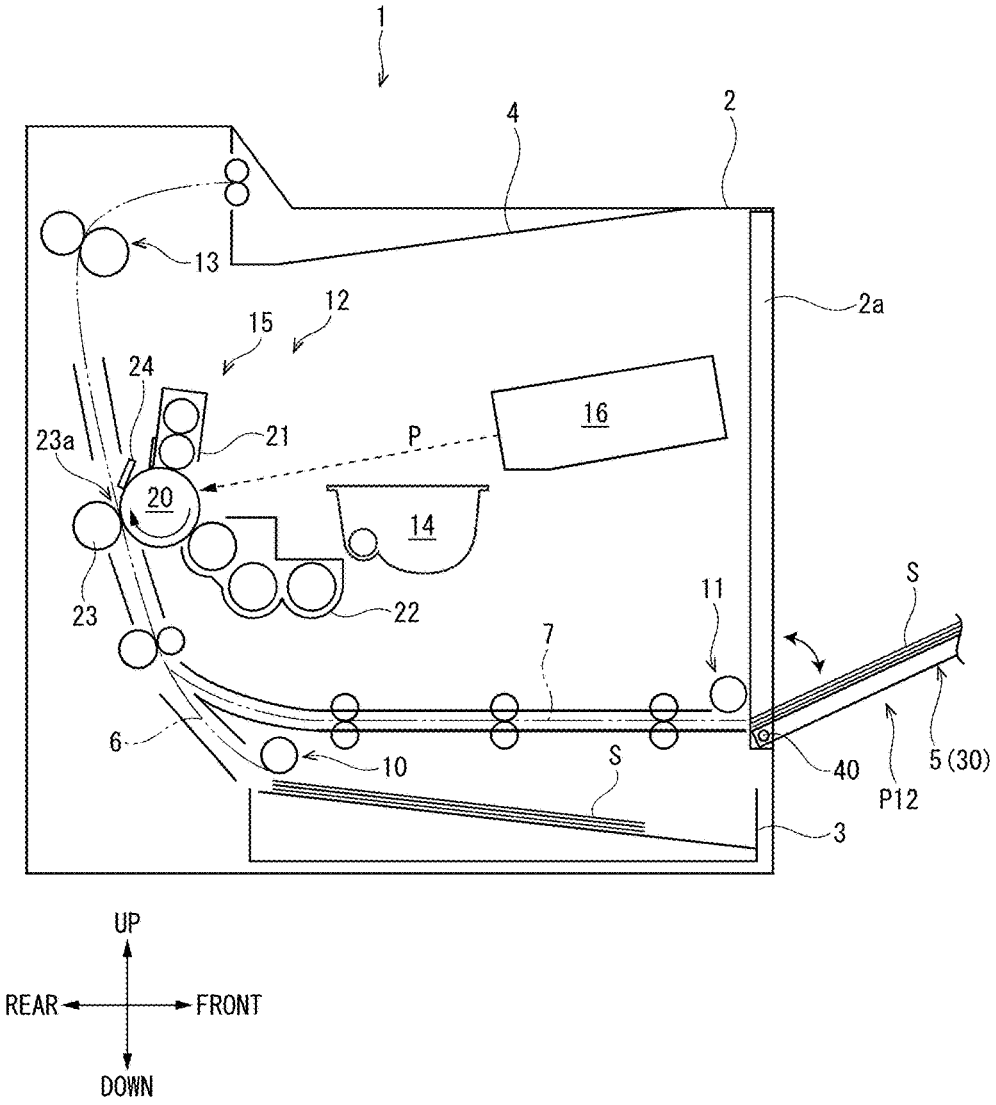
FIG. 2 is a sectional view schematically showing an inner structure of the printer according to one embodiment of the present disclosure.

With reference to FIGS. 1 and 2, a printer 1 as an image forming apparatus will be described. FIG. 1 is a perspective view illustrating the printer 1. FIG. 2 is a sectional view schematically showing an inner structure of the printer 1.

As shown in FIG. 1, the printer 1 includes an apparatus body 2, a sheet feed cassette 3, a sheet discharge tray 4 and a manual feed tray 5. The apparatus body 2 is formed substantially into a shape of a box.

The sheet feed cassette 3 is provided in a lower part of the apparatus body 2. The sheet discharge tray 4 is provided in a upper part of the apparatus body 2. The manual feed tray 5 is provided turnably at a front surface of the apparatus body 2.

As shown in FIG. 2, a sheet S (a bundle of layered sheets S) is stored within the sheet feed cassette 3. The manual feed tray 5 is stored in a concave part 2*a* provided at the front surface of the apparatus body 2. While a detail will be described later, the manual feed tray 5 becomes usable by being disposed at an open position P12 where the manual feed tray 5 extends in an obliquely up and forward direction from the front surface of the apparatus body 2. The sheet S is loaded on the manual feed tray 5 disposed at the open position P12. It is noted that the sheet S is not limited to be a sheet of paper but also may be a resin film or the like.

A conveyance path 6 and a manual feed conveyance path 7 are formed in the apparatus body 2. The conveyance path 6 extends in a vertical direction so as to link the sheet feed cassette 3 with the sheet discharge tray 4. The manual feed conveyance path 7 extends in a front-back direction so as to link the manual feed tray 5 with an upstream side of the conveyance path 6. The manual feed conveyance path 7 is provided above the sheet feed cassette 3.

The printer 1 includes a cassette sheet feed part 10, a manual sheet feed part 11, an image forming part 12 and a fixing unit 13 within the apparatus body 2. The cassette sheet feed part 10 is provided upstream of the conveyance path 6. The manual sheet feed part 11 is provided upstream of the manual feed conveyance path 7. The image forming part 12 is provided at an intermediate part of the conveyance path 6. The fixing unit 13 is provided downstream of the conveyance path 6.

The cassette sheet feed part 10 includes a plurality of rollers and others delivering the sheet S stored in the sheet feed cassette 3 one by one to the conveyance path 6. In the same manner, the manual sheet feed part 11 (supply part) includes a plurality of rollers and others delivering the sheet S loaded on the manual feed tray 5 one by one to the manual feed conveyance path 7.

The image forming part 12 includes a tonner container 14, a drum unit 15 and an optical scanning device 16. The tonner container 14 houses black toner (developing agents).

The drum unit 15 includes a photosensitive drum 20, a charging device 21, a development device 22, a transfer roller 23 and a cleaning device 24. The photosensitive drum 20 bears a developed toner image. The transfer roller 23 is in contact with the photosensitive drum 20 and forms a transfer nip 23*a*. The drum unit 15 transfers the toner image on the sheet S passing through the transfer nip 23*a*. The fixing unit 13 fixes the toner image on the sheet S. The sheet S on which the toner image has been fixed is discharged to the sheet discharge tray 4.

Figure 3:
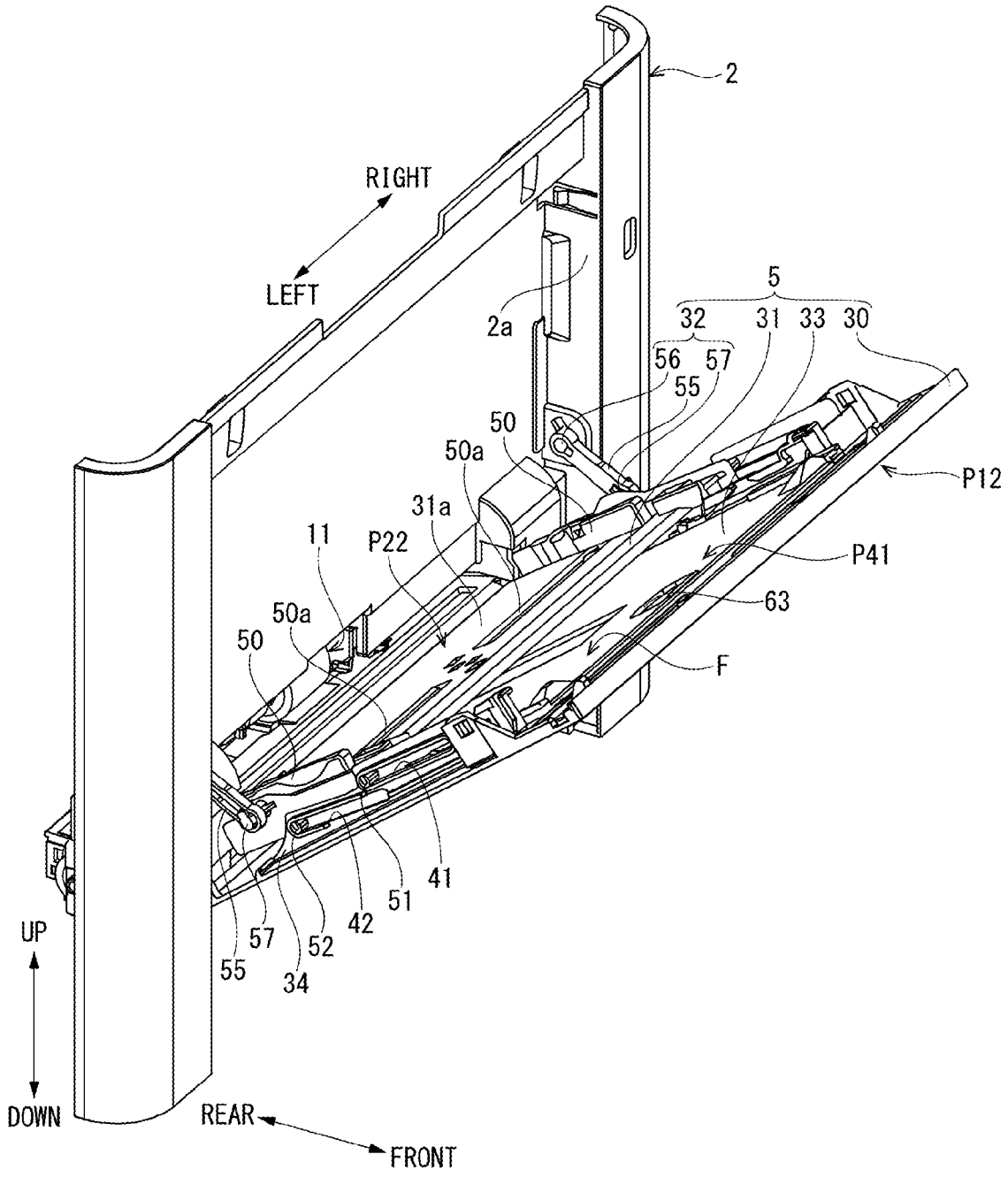
FIG. 3 is a perspective view illustrating a manual feed tray of one embodiment of the present disclosure.
Figure 4:
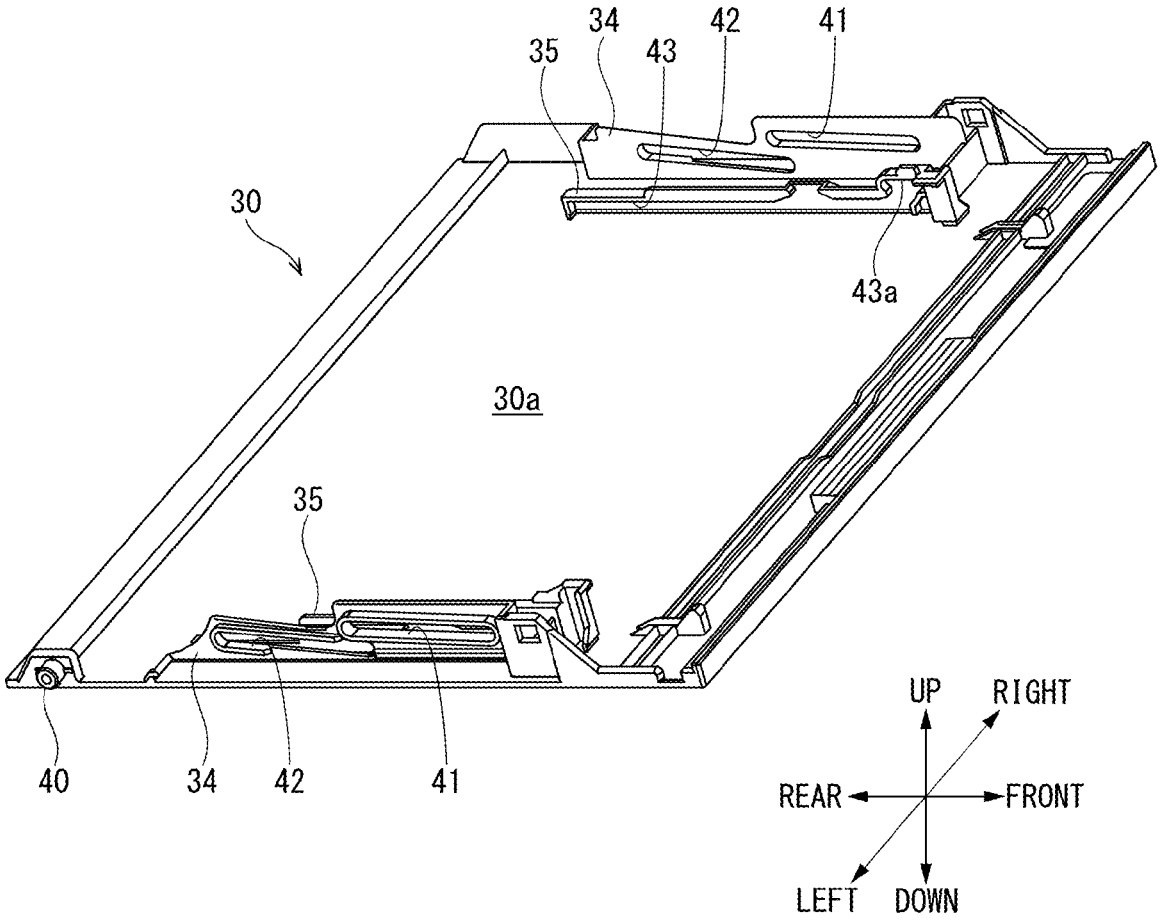
FIG. 4 is a perspective view illustrating a cover of the manual feed tray of one embodiment of the present disclosure.
Figure 5:
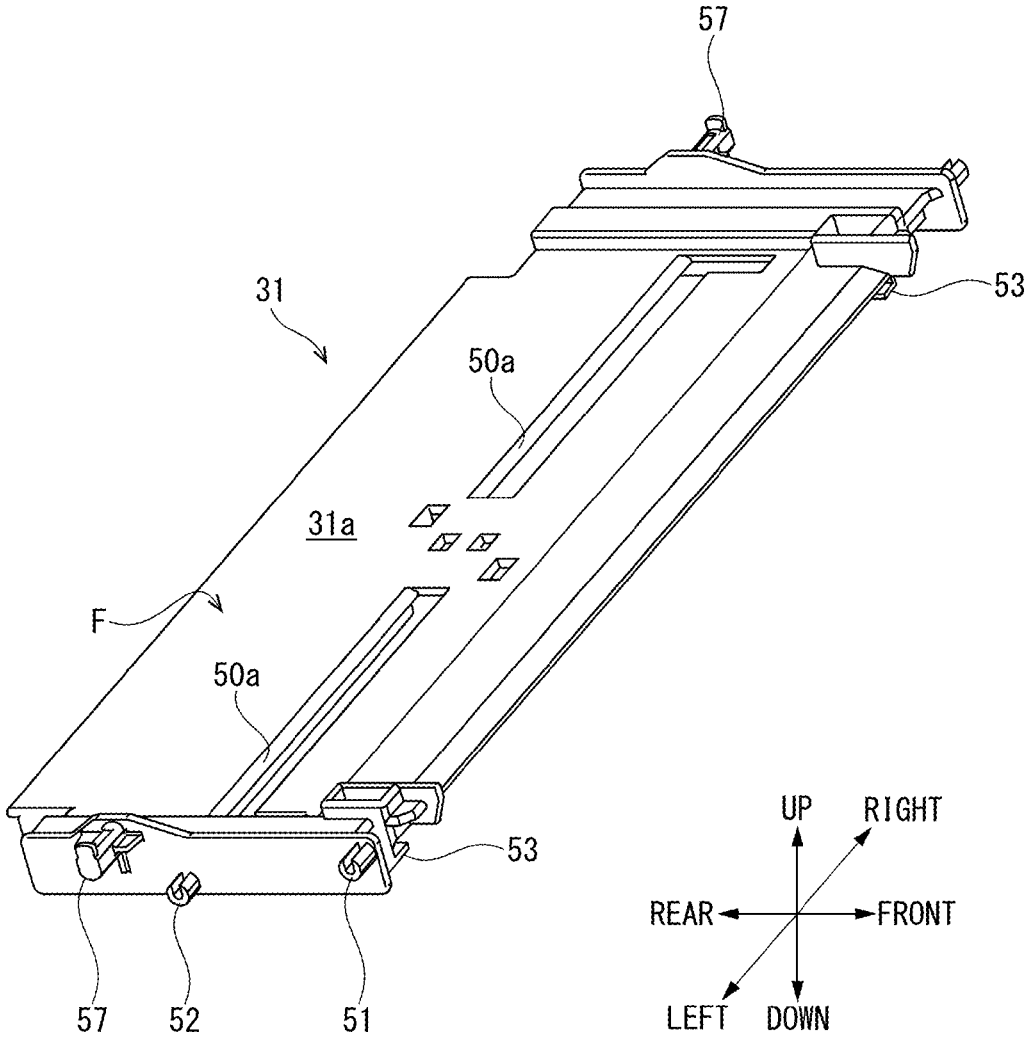
FIG. 5 is a perspective view illustrating a base tray of the manual feed tray of one embodiment of the present disclosure.

Next, reference to FIGS. 3 through 6, the manual feed tray 5 as a sheet supplying apparatus will be described. FIG. 3 is a perspective view illustrating a manual feed tray 5. FIG. 4 is a perspective view illustrating a cover 30. FIG. 5 is a perspective view illustrating a base tray 31.

As shown in FIG. 3, the manual feed tray 5 includes a cover 30, a base tray 31, an interlock mechanism 32 and an auxiliary tray 33. The cover 30 composes the front surface of the apparatus body 2 (see FIG. 1). The base tray 31 and the auxiliary tray 33 are supported by one surface (an upper surface 30*a*) of the cover 30. The interlock mechanism 32 is provided so as to link the apparatus body 2 with the base tray 31.

As shown in FIG. 4, the cover 30 is formed of synthetic resin approximately into a rectangular plate (thin plate). The cover 30 includes a pair of left and right turning shafts 40, a pair of left and right upstream base rail 41, a pair of left and right downstream base rail 42 and a pair of left and right auxiliary rail 43.

The pair of left and right turning shafts 40 projects outwardly from widthwise (horizontal) both side surfaces at a downstream end part of the cover 30. The turning shaft 40 is pivotally supported by a bearing part not shown formed in the concave part 2*a* of the apparatus body 2. The cover 30 (the manual feed tray 5) is supported turnably on the apparatus body 2 (the concave part 2*a*) through the turning shafts 40. The cover 30 (the manual feed tray 5) is turnable between the close position P11 (see FIG. 1) where the cover 30 is stored within the concave part 2*a* of the apparatus body 2 and covers the manual sheet feed part 11 and the open position P12 (see FIG. 3) where the cover 30 exposes the manual sheet feed part 11.

The cover 30 composes the front surface of the apparatus body 2 by being displaced to the close position P11 (see FIG. 1) . Meanwhile, the cover 30 takes a posture in which the cover 30 extends out of the concave part 2*a* in an obliquely upper front direction (referred to as a 'manual feed posture' hereinafter) by turning to the outside from the close position P11 and by displacing to the open position P12 (see FIG. 3). It is noted the following description will be made based on the state in which the cover 30 is displaced to the open position P12 (the manual feed posture) unless specified otherwise.

The pair of left and right base ribs 34 and a pair of left and right auxiliary ribs 35 are provided so as to erect on the upper surface 30*a* of the cover 30.

The pair of left and right base ribs 34 extends along the conveyance direction (front-rear direction) at the widthwise both sides of the upper surface 30*a*. The pair of left and right auxiliary ribs 35 extends along the conveyance direction between (inside) the pair of left and right base ribs 34. The auxiliary rib 35 is formed to have an approximately same length with the base rib 34. Still further, the auxiliary rib 35 is formed to be lower than the base rib 34.

The upstream base rail 41 and the downstream base rail 42 are formed to be long holes respectively penetrating through the base rib 34 in the horizontal direction. The upstream base rail 41 and the downstream base rail 42 extend along the conveyance direction on the widthwise both sides of the cover 30, respectively. The upstream base rail 41 is formed upstream (front side) of the base rib 34, and the downstream base rail 42 is formed downstream (rear side) of the base rib 34, respectively. Still further, the downstream base rail 42 is formed slightly below the upstream base rail 41 in a side view. An upstream end of the downstream base rail 42 overlaps with a downstream end of the upstream base rail 41.

The upstream base rail 41 and the downstream base rail 42 are formed aslant such that they separate from the upper surface 30*a* of the cover 30 from upstream (front side) to downstream (rear side), respectively. That is, the upstream base rail 41 and the downstream base rail 42 are formed with a rising gradient from upstream to downstream, respectively. The downstream base rail 42 is formed such that an inclination angle (an angle formed with the upper surface 30*a*) is larger than that of the upstream base rail 41.

The pair of left and right auxiliary rails 43 is provided concavely from inner side surfaces (surfaces opposing with each other) of the auxiliary rib 35 toward the outside. The pair of left and right auxiliary rails extends along the conveyance direction on the widthwise both sides of the cover 30. A fitting concave part 43*a* is formed so as to bulge upward at an upper end of the auxiliary rail 43.

As shown in FIG. 5, the base tray 31 is formed of synthetic resin and approximately into a rectangular plate. The base tray 31 is disposed on the upper surface 30*a* of the cover 30 disposed at the open position P12 and composes a part of the loading surface F for loading the sheet S (see FIG. 3). The base tray 31 includes a pair of left and right respective cursors 50 (see FIG. 3), a pair of left and right upstream guide bosses 51, a pair of left and right downstream guide boss 52 and a pair of left and right hook 53. It is noted that in FIG. 5, the respective cursors 50 are not illustrated.

As shown in FIG. 3, the pair of left and right cursors 50 is formed approximately into a rectangular parallelepiped shape which is long in the conveyance direction. The pair of left and right cursors 50 is disposed on the upper surface 31*a* of the base tray 31 so as to face with each other. The pair of left and right cursors 50 is connected with an interlock mechanism such as a rack and a pinion. With an operation of the interlock mechanism, the pair of left and right cursors 50 slides bilaterally symmetrically along a cursor rail 50*a* formed on the upper surface 31*a*. The respective cursors 50 align a horizontal width of (a bundle of) the sheet S loaded on the loading surface F.

As shown in FIG. 5, the upstream guide boss and the downstream guide boss 52 are formed approximately into a cylindrical shape, respectively. The pair of left and right upstream guide bosses 51 is provided so as to project outward from the both widthwise side surfaces at an upstream end part of the base tray 31. The pair of left and right downstream guide bosses 52 is provided so as to project outward from the both widthwise side surfaces at an intermediate part in the conveyance direction of the base tray 31. It is noted that the upstream guide boss 51 is disposed slightly above the downstream guide boss 52, respectively.

As shown in FIG. 3, the upstream guide boss 51 is slidably engaged with the upstream base rail 41, and the downstream guide boss 52 is slidably engaged with the downstream base rail 42, respectively. This arrangement makes it possible for the base tray 31 to move in the conveyance direction with respect to the cover 30 while being guided by the respective base rails 41 and 42. Specifically, the base tray 31 is movable between an upstream position P21 (see FIG. 7) where the respective guide bosses 51 and 52 are positioned at most upstream end parts of the respective base rails 41 and 42 and a downstream position P22 (see FIG. 3) where the respective guide bosses 51 and 52 are positioned at most downstream end parts of the respective base rails 41 and 42.

As shown in FIG. 5, the hook 53, i.e., an engaged part, is provided so as to project downward from a lower surface of the base tray 31. The pair of left and right hooks 53 is formed on the widthwise both sides at the upstream end part of the base tray 31. Each hook 53 is formed approximately into a shape of L in a front view by bending a front end extending downward from the lower surface of the base tray 31 toward inside in the width direction.

A pair of left and right movable pins 57 is provided so as to project on the both widthwise side surfaces at the downstream end part of the base tray 31. The movable pin 57 is formed approximately into an oval columnar shape and is disposed at an upper as compared to the respective guide bosses 51 and 52 in a side view.

As shown in FIG. 3, the interlock mechanism 32 includes a pair of left and right link member 55, a pair of left and right fixed pin 56 and a pair of left and right movable pin 57. The link member 55 is formed of synthetic resin and approximately into a rectangular parallelepiped shape for example. The fixing pin 56 is provided so as to project on an inner side surface of the concave part 2*a*.

The pair of left and right link members 55 is installed between the apparatus body 2 (the concave part 2*a*) and the base tray 31. The fixed pin 56 is disposed above the bearing (or the turning shaft 40 of the cover 30) of the concave part 2*a*. The fixed pin 56 turnably supports one end part of the link member 55 to the apparatus body 2 (the concave part 2*a*). The movable pin 57 described above turnably supports the other end part of the link member 55 to the apparatus body 2 (the concave part 2*a*). It is noted that in the state in which the cover 30 is displaced to the open position P12, the link member 55 is attached with a posture of a downward gradient from downstream to upstream.

When the cover 30 is turned, the link member 55 (the movable pin 57) turns centering on the fixed pin 56 and the base tray 31 connected through the movable pin 57 is moved. Specifically, the interlock mechanism 32 (the link member 55) moves the base tray 31 downstream (the downstream position P22) in linkage with the cover 30 turning from the close position P11 to the open position P12 (see FIG. 3). Still further, the interlock mechanism 32 (the link member 55) moves the base tray 31 upstream (the upstream position P21) by interlocking with the cover 30 turning from the open position P12 to the close position P11 (see FIG. 7).

Figure 6:
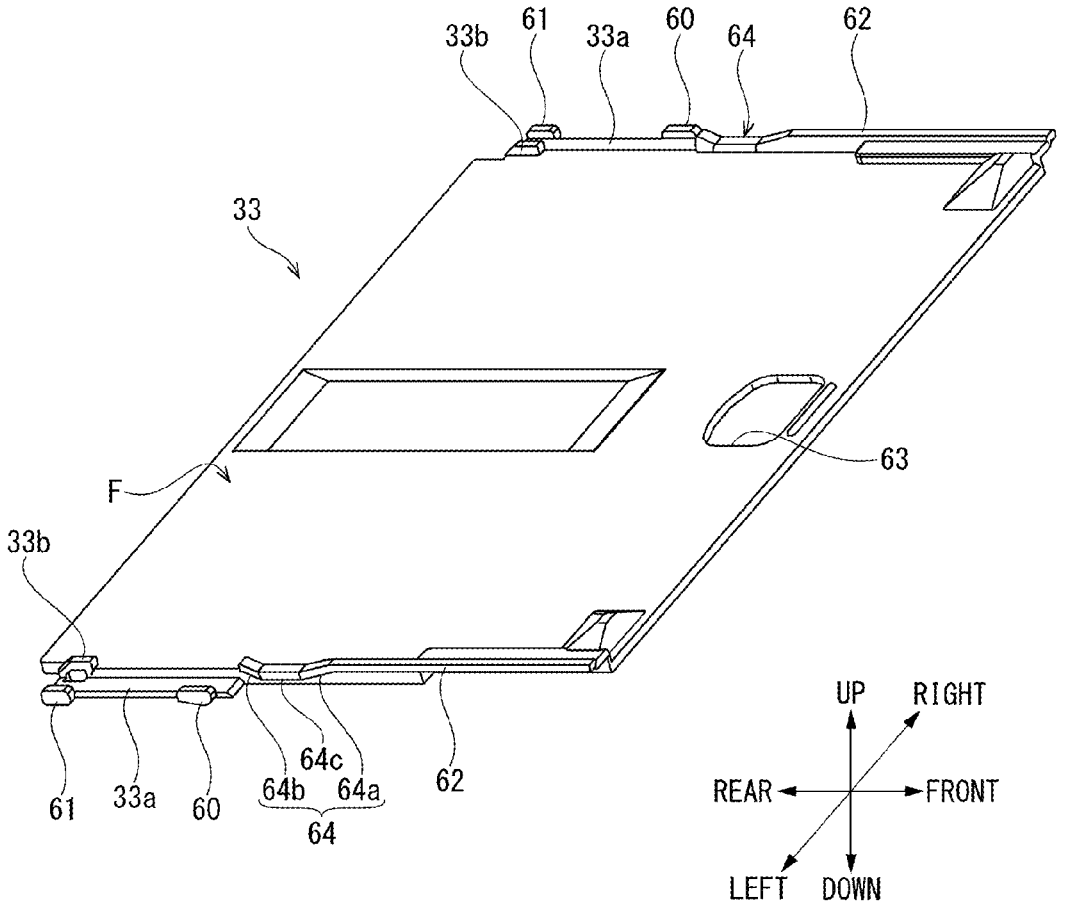
FIG. 6 is a perspective view illustrating a auxiliary tray of the manual feed tray of one embodiment of the present disclosure.

As shown in FIG. 6, the auxiliary tray 33 is formed of synthetic resin and is formed approximately into a rectangular plate (thin plate) for example. The auxiliary tray 33 composes apart of the loading surface F together with the base tray 31 on the upper surface 30*a* side of the cover 30 disposed at the open position P12 (see FIG. 3). A downstream side of the auxiliary tray 33 is disposed between the cover 30 and the base tray 31 (see FIG. 7). The auxiliary tray 33 includes a pair of left and right upstream slide boss 60, a pair of left and right downstream slide boss 61, a pair of left and right engage part 62 and an operating hole 63.

A pair of left and right slide plates 33*a* extending outward from the widthwise both surfaces is formed downstream of the auxiliary tray 33. The slide plate 33*a* is formed approximately into a rectangular plate which is long in the conveyance direction. A convex part 33*b* is formed projectively at a downstream end of the slide plate 33*a*.

The upstream slide boss 60 and the downstream slide boss 61 are formed approximately into oval columnar shape which is long in the conveyance direction, respectively. The pair of left and right upstream slide bosses 60 is provided so as to project outward from the both widthwise side surfaces at an upstream end part of the slide plate parts 33*a*, respectively. The pair of left and right downstream slide bosses 61 is provided so as to project outward from the both widthwise side surfaces at the downstream end part of the slide plate 33*a*, respectively. The upstream slide boss 60 and the downstream slide boss 61 are slidably engaged with the auxiliary rail 43 (see FIG. 4), respectively.

The slide bosses 60 and 61 engage respectively with the auxiliary rail 43 in a state in which the bosses 60 and 61 are permitted to move in the vertical direction (a sheet loading direction). Therefore, the auxiliary tray 33 is able to displace between a storage position P31 (see FIG. 7) where the auxiliary tray 33 is in contact (or in adjacent) with the upper surface 30*a* of the cover 30 disposed at the close position P11 and a raising position P32 (see FIG. 9) where the auxiliary tray 33 separates from the upper surface 30*a* of the cover 30 disposed at the open position P12. It is noted that the raising position P32 is set at a position separated more from the upper surface 30*a* than the storage position P31.

The engage part 62 is formed to be narrower widthwise than the slide plate 33*a* and approximately into a rectangular plate which is long in the conveyance direction. The pair of left and right engage parts 62 is formed to extend outside from the widthwise both side surfaces of the auxiliary tray 33 at upstream of the slide plate 33*a*. The engage part 62 engages slidably with the hook 53 of the base tray 31 (see FIG. 7). That is, the auxiliary tray 33 is disposed so as to be embraced between the pair of left and right hooks 53 through the pair of left and right engage parts 62.

The auxiliary tray 33 is provided movably in the conveyance direction through the slide bosses 60 and 61 in slidable-contact with the auxiliary rail 43 and through the engage part 62 in slidable-contact with the hook 53. Specifically, the auxiliary tray 33 is movable between a draw-in position P41 (see FIG. 3) where the downstream side of the auxiliary tray 33 is entered between the cover 30 and the base tray 31 and a draw-out position P42 (see FIG. 1) where the auxiliary tray 33 is drawn out upstream more than the upstream end of the cover 30.

A lifting part 64 is formed at a downstream end of the engage part 62. The lifting part 64 is formed so as to bend and project the engage part 62 downward approximately into a trapezoidal shape in a side view.

The lifting part 64 includes an upstream inclined surface 64*a*, a downstream inclined surface 64*b*, and a pressing surface 64*c* formed at a lower side thereof. The upstream inclined surface 64*a* is formed with a downward gradient from upstream to downstream. The downstream inclined surface 64*b* is formed with a rising gradient from upstream to downstream. The pressing surface 64*c* connects the upstream inclined surface 64*a* with the downstream inclined surface 64*b* and is formed in parallel with the engage part 62.

The operating hole 63 is provided so as to penetrate vertically through the auxiliary tray 33 and so as to be formed approximately into an oval shape in a plan view. The operating hole 63 is perforated at a widthwise center part on an upstream side of the auxiliary tray 33. The operating hole 63 is formed so that the user can hook his/her finger in drawing the auxiliary tray 33 to the upstream side.

Figure 7:
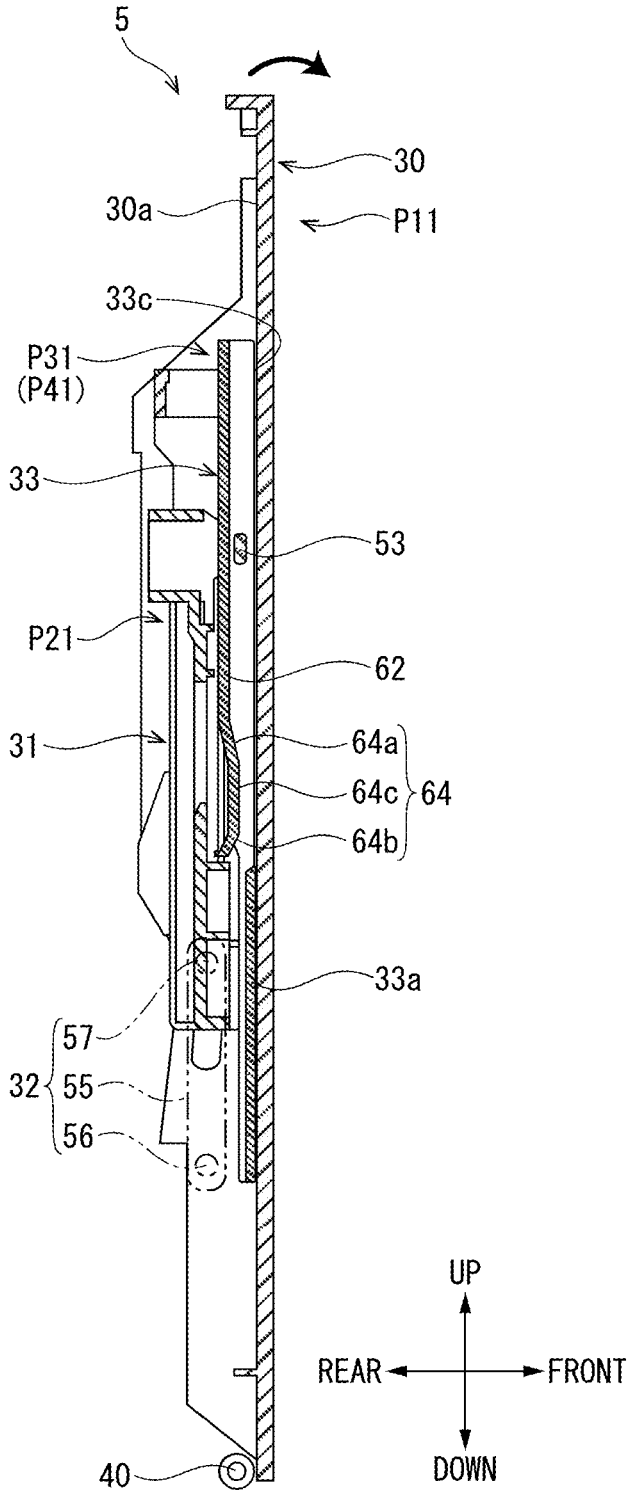
FIG. 7 is a section view illustrating the manual feed tray of one embodiment of the present disclosure in a state in which the cover of the manual feed tray is displaced to a close position.
Figure 8:
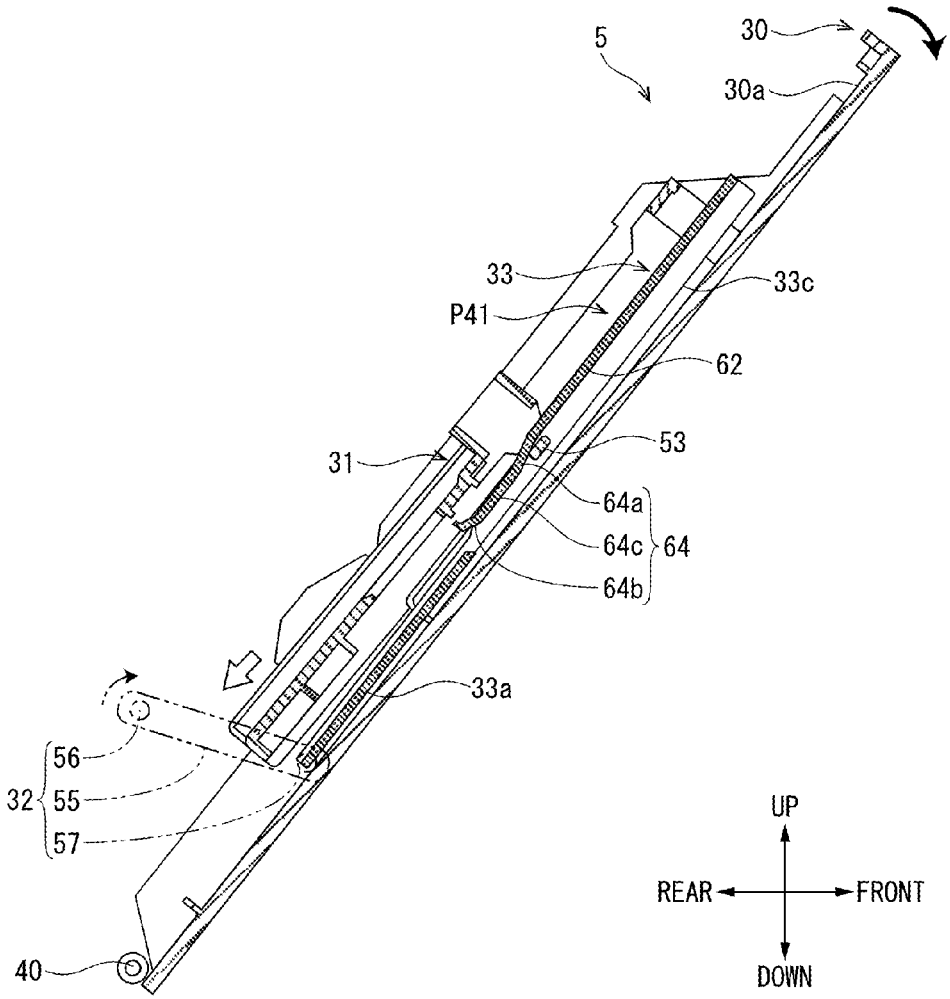
FIG. 8 is a section view illustrating the manual feed tray of one embodiment of the present disclosure in a state in which the cover of the manual feed tray is on a way of being displaced from the close position to an open position.
Figure 9:
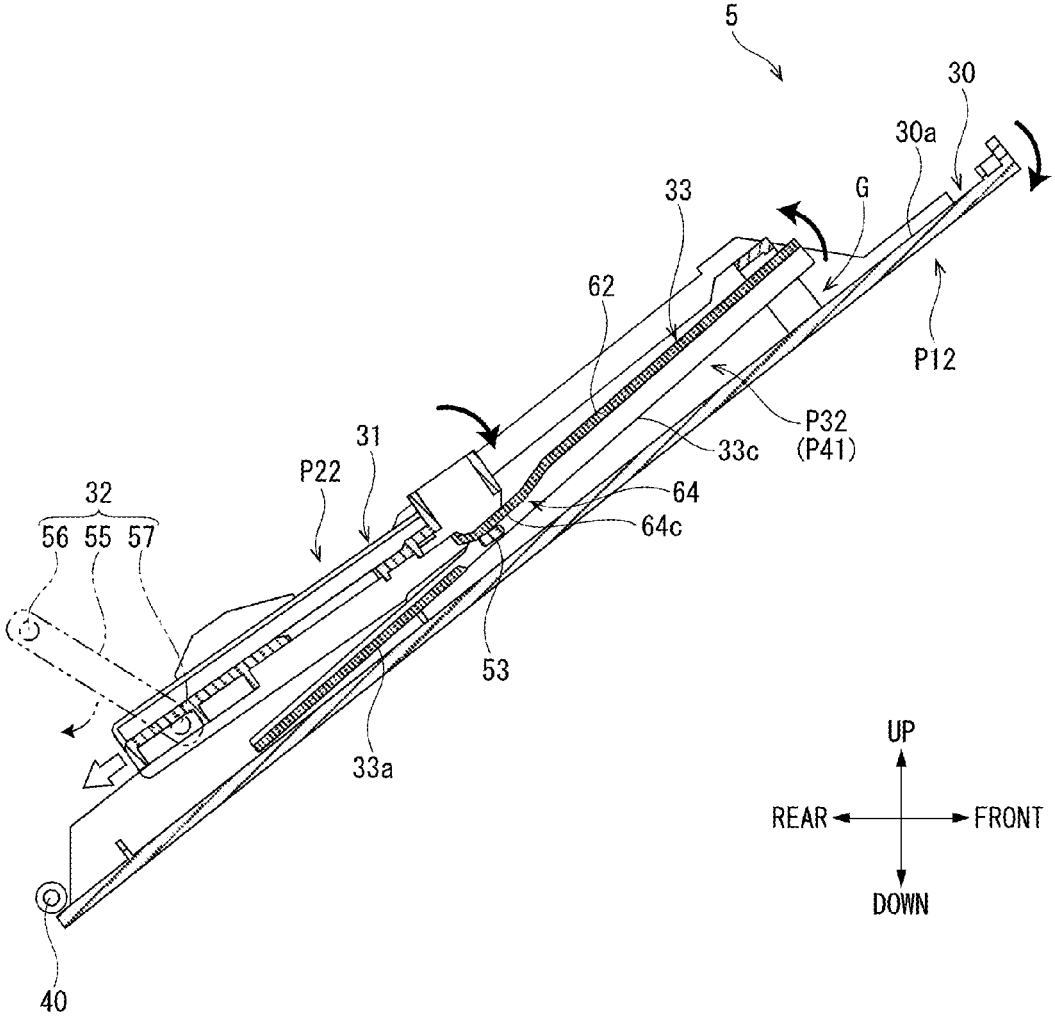
FIG. 9 is a section view illustrating the manual feed tray of one embodiment of the present disclosure in a state in which the cover of the manual feed tray is displaced to the open position.
Figure 10:
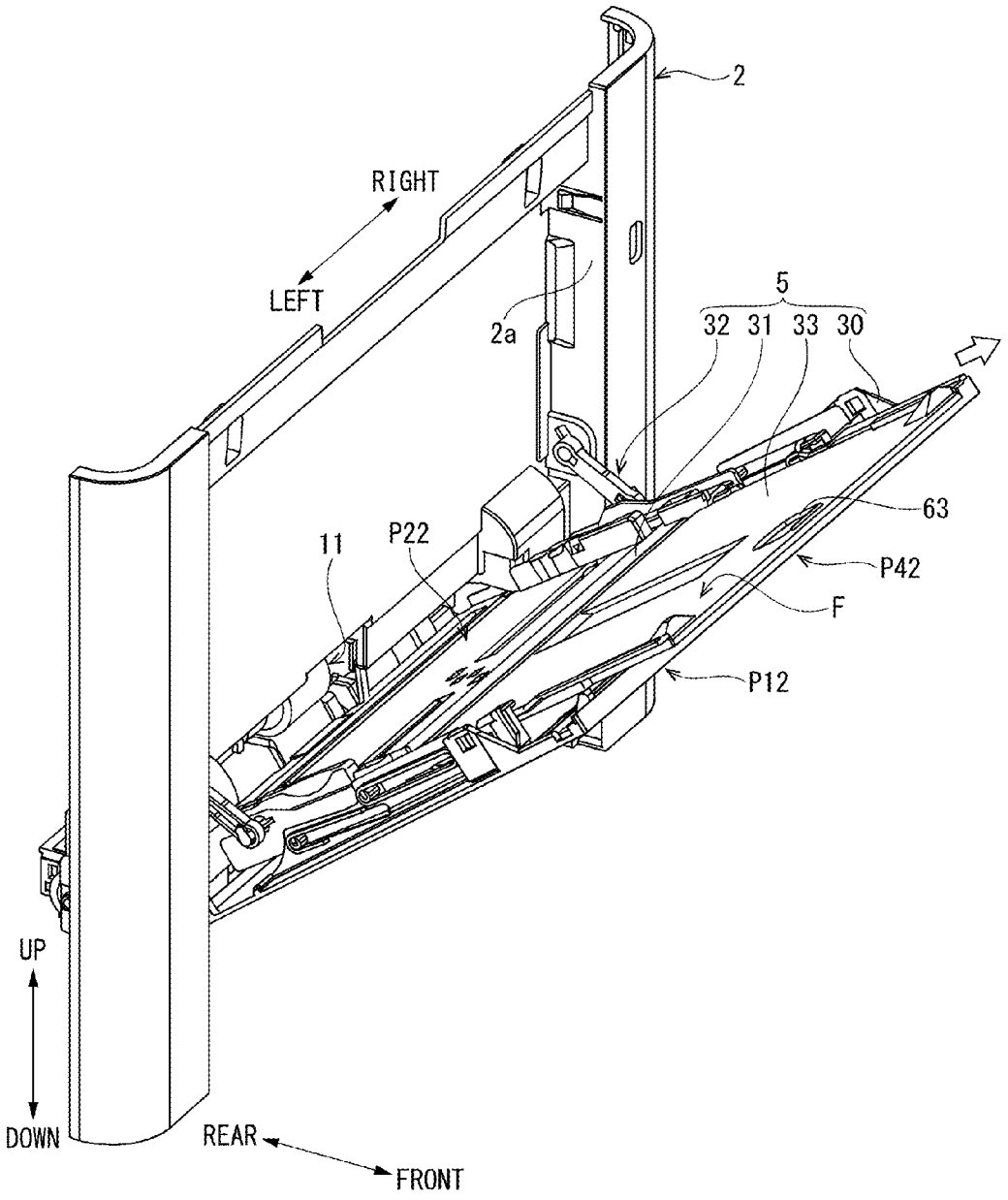
FIG. 10 is a perspective view illustrating the manual feed tray of one embodiment of the present disclosure in a state in which an auxiliary tray of the manual feed tray is displaced to the draw-out position.

Next, reference to FIGS. 7 through 10, an operation (procedure) in using the manual feed tray 5 will be described. FIG. 7 is a section view illustrating in a state in which the cover 30 is displaced to a close position P11. FIG. 8 is a section view illustrating in a state in which the cover 30 is on a way of being displaced from the close position P11 to an open position P12. FIG. 9 is a section view illustrating in a state in which the cover 30 is displaced to the open position P12. FIG. 10 is a perspective view illustrating in a state in which an auxiliary tray 33 is displaced to the draw-out position P42.

It is noted that a state in which the cover 30 is disposed at the close position P11 as illustrated in FIG. 7 will be defined to be an initial state. In the initial state, the base tray 31 is displaced to the upstream position P21. In the initial state, the auxiliary tray 33 is displaced to the draw-in position P41 and to the storage position P31. At this time, the lower surface 33*c* of the auxiliary tray 33 is in contact with the upper surface 30*a* of the cover 30 disposed at the close position P11.

In the case of using the manual feed tray 5, the user hooks his/her finger to the upper end of the cover 30 (see FIG. 7) and turns the cover 30 forward. As shown in FIG. 8, the cover 30 turns centering on the turning shaft 40 (clockwise in FIG. 8). Still further, because the base tray 31 and the auxiliary tray 33 are disposed on the upper surface 30*a* of the cover 30, they turns centering on the turning shaft 40 together with the cover 30. Still further, because the link member 55 is connected with the base tray 31 through the movable pin 57, the link member 55 turns centering on the fixed pin 56 (clockwise in FIG. 8) while pulling the base tray 31 to the downstream side. As described above, the link member 55 can precisely interlock the cover 30 with the base tray 31.

As shown in FIGS. 8 and 9, the base tray 31 moves from the upstream position P21 to the downstream position P22 along the base rails 41 and 42 during when the cover 30 turns from the close position P11 to the open position P12. The hook 53 of the base tray 31 moves to the downstream side along the engage part 62 of the auxiliary tray 33 during when the base tray 31 moves from the upstream position P21 to the downstream position P22. When the move of the base tray 31 advances, the hook 53 comes into contact with the lifting part 64 of the auxiliary tray 33 and slides downstream along the upstream inclined surface 64*a* of the lifting part 64 (see FIG. 8). The hook 53 slides along the upstream inclined surface 64*a* to the pressing surface 64*c* (see FIG. 9).

As shown in FIGS. 9, when the cover 30 arrives at the open position P12 (takes the manual feed posture), the base tray 31 arrives at the downstream position P22. At this time, the hook 53 comes into contact (pressure contact) with the downstream side of the pressing surface 64*c*. That is, because the lifting part 64 rides over the hook 53 relatively, the auxiliary tray 33 is raised from the storage position P31 to the raising position P32.

The base tray 31 is displaced to a posture inclined along the base rails 41 and 42 in the state in which the base tray 31 has arrived at the downstream position P22. More specifically, the base tray 31 is displaced to the posture in which the upstream side thereof is brought into adjacent to the upper surface 30*a* (upper surface of the auxiliary tray 33) of the cover 30, and the downstream side thereof is separated from the upper surface 30*a*. The upstream end part of the base tray 31 presses down the downstream side of the auxiliary tray 33 by changing the angle of the base tray 31. Therefore, the upstream side of the auxiliary tray 33 jumps up at a fulcrum of the lifting part 64 (more accurately, a contact point of the hook 53 with the pressing surface 64*c*) (principle of leverage). That is, the base tray 31 presses the downstream side of the auxiliary tray 33 displaced to the raising position P32 toward the cover 30. This arrangement makes it possible to adequately keep the condition in which the auxiliary tray 33 is displaced to the raising position P32.

In succession, the user hooks his/her finger to the operating hole 63 to draw the auxiliary tray 33 forward (more accurately, obliquely upper front side) (see FIG. 10). The auxiliary tray 33 moves from the draw-in position P41 to the draw-out position P42 along the auxiliary rail 43. At this time, a gap G is formed between the auxiliary tray 33 displaced to the raising position P32 and the upper surface 30*a* of the cover 30 (see FIG. 9). Therefore, the user can enter his/her finger hooked to the operating hole 63 to this gap G is drawing the auxiliary tray 33. Thereby, the user can firmly hook his/her finger to the operating hole 63, so that the operation of drawing the auxiliary tray 33 can be made readily. It is noted that if the auxiliary tray 33 arrives at the draw-out position P42, the convex part 33*b* (see FIG. 6) of the auxiliary tray 33 fits into the fitting concave part 43*a* (see FIG. 4) of the auxiliary rail 43. Thereby, the drawn-out condition of the auxiliary tray 33 is maintained.

Then, the user can load the sheet S on the loading surface F composed of the upper surface 31*a* of the base tray 31 and the upper surface of the auxiliary tray 33. It is noted that the auxiliary tray 33 is what drawn in and out corresponding to size of the sheet S (length in the conveyance direction) and functions as the loading surface F even if the auxiliary tray 33 is displaced to the draw-in position P41.

It is noted that the manual feed tray 5 is stored in the concave part 2*a* when it is not used. An operation (procedure) in storing the manual feed tray 5 to the concave part 2*a* is just opposite to the operation (procedure) in using the manual feed tray 5 described above, an explanation thereof will be omitted here.

According to the manual feed tray 5 of the present embodiment described above, the auxiliary tray 33 is in contact with the cover 30 each other in the initial state. That is, the auxiliary tray 33 is disposed in a condition in which the gap between the auxiliary tray 33 and the upper surface 30*a* of the cover 30 disposed at the close position P11 is minimized. This arrangement makes it possible to downsize (thin) the manual feed tray 5 and the concave part 2*a* of the apparatus body 2 storing the manual feed tray 5.

Still further, according to the manual feed tray 5 of the present embodiment, the lifting part 64 of the engage part 62 comes into pressure contact with the hook 53, in the process of moving the base tray 31 to the downstream position P22, and displaces the auxiliary tray 33 from the storage e position P31 to the raising position P32. The base tray 31 moves downstream in linkage with the cover 30 being opened. Along with the move of the base tray 31, the auxiliary tray 33 automatically separates from the cover 30 through the lifting part 64. Thus, it is possible to separate the auxiliary tray 33 from the cover 30 just by opening the cover 30. Still further, because the auxiliary tray 33 floats up from the cover 30, the user can readily grasp the auxiliary tray 33. This arrangement makes it possible for the user to draw the auxiliary tray 33 out smoothly.

Figure 11:
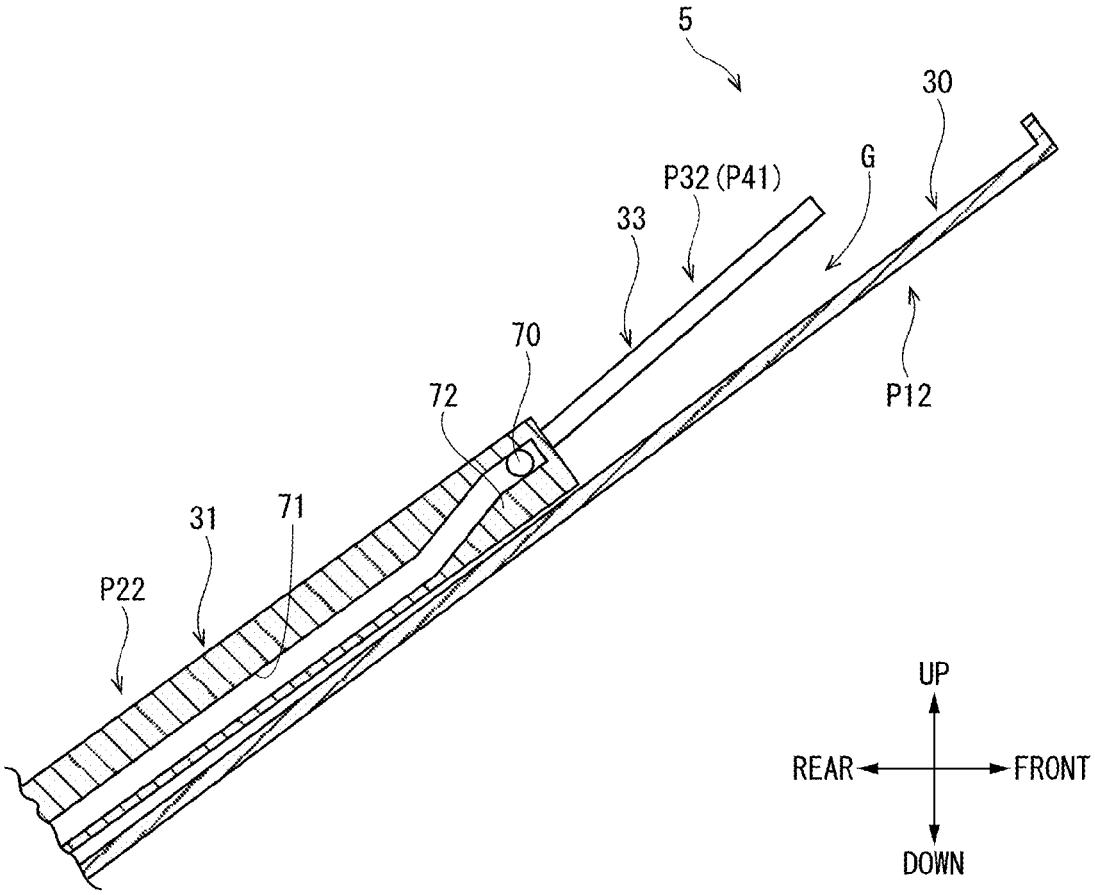
FIG. 11 is a section view illustrating a manual feed tray of a modified example of one embodiment of the present disclosure.

It is noted that while the lifting part 64 is provided in the engage part 62 in the manual feed tray 5 of the present embodiment, the present disclosure is not limited to such configuration. For instance, as illustrated in FIG. 11, a pair of left and right engage bosses 70 may be provided as an engage part on the auxiliary tray 33 and a pair of left and right engage grooves 71 may be provided as an engaged part on the base tray 31 for example. The engage boss 70 slidably engages with the engage groove 71. Then, a lifting part 72 may be formed in the engage groove 71.

It is noted that while the base rails 41 and 42 are provided in the cover 30 in the manual feed tray 5 of the present embodiment, the present disclosure is not limited to such configuration. Although not shown, the base rails 41 and 42 may be provided in the base tray 31. In this case, the guide bosses 51 and 52 are provided in the cover 30.

It is noted that while the auxiliary rail 43 is provided in the cover 30 in the manual feed tray 5 of the present embodiment, the present disclosure is not limited to such configuration. Although not shown, the auxiliary rail 43 may be provided in the auxiliary tray 33. In this case, the slide bosses 60 and 61 are provided in the cover 30.

Still further, the case in which the present disclosure is applied to the monochrome printer 1 as one example has been described in the present embodiment, the present disclosure is not limited to such case, and the present disclosure is applicable also to a color printer, a facsimile, a multi-function printer, and the like.

While the preferable embodiment and its modified example of the sheet supplying apparatus and the image forming apparatus including this of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet supplying apparatus comprising:

a supply part provided in an apparatus body and configured to deliver a sheet;

a cover supported openably on a side surface of the apparatus body through a turning shaft and turnable between a close position covering the supply part and an open position exposing the supply part;

abase tray disposed on an upper surface of the cover disposed at the open position, composing a part of a loading surface on which the sheet is loaded, and movable in a sheet conveyance direction with respect to the cover;

an interlock mechanism configured to move the base tray downstream in the conveyance direction by interlocking with the cover turning from the close position to the open position, and configured to move the base tray upstream in the conveyance direction by interlocking with the cover turning from the open position to the close position; and an auxiliary tray provided movably in the conveyance direction through an engage part formed so as to be in slidable contact with an engaged part formed on the base tray and so as to be able to displace between a storage position where the auxiliary tray is in contact or in adjacent to the upper surface of the cover disposed at the close position and a raising position where the auxiliary tray separates from the upper surface of the cover disposed at the open position;

a lifting part provided at either one of the engage part and the engaged part comes into pressure contact with the another one among the engage part and the engaged part and displaces the auxiliary tray from the storage position to the raising position in a process of moving the base tray downstream in the conveyance direction by the interlock mechanism.

2. The sheet supplying apparatus according to claim 1, wherein the interlock mechanism comprises:

a link member installed between the apparatus body and the base tray;

a fixed pin disposed at an upper part of the turning shaft of the cover and turnably supporting one end part of the link member on the apparatus body; and a movable pin configured to turnably support another end part of the link member on the base tray.

3. The sheet supplying apparatus according to claim 1, wherein either one among the cover and the base tray comprises a pair of base rails configured to extend in the conveyance direction at widthwise both sides orthogonal to the conveyance direction, another one among the cover and the base tray comprises a pair of guide bosses provided projectively on the widthwise both sides and configured to slidably engage with the base rails, the base rail is formed aslant so as to separate from the upper surface of the cover from upstream to downstream in the conveyance direction, and the base tray presses a downstream side in the conveyance direction of the auxiliary tray which is displaced to the raising position by displacing to a posture by which the base tray inclines along the base rail in a condition in which the base tray has moved to the downstream side in the conveyance direction.

4. The sheet supplying apparatus according to claim 1, wherein either one of the cover and the auxiliary tray comprises a pair of auxiliary rails extended along the conveyance direction on the widthwise both sides orthogonal to the conveyance direction, another one of the cover and the auxiliary tray comprises a pair of slide bosses provided projectively on the widthwise both sides and configured to slidably engaging with the auxiliary rails, and the auxiliary tray is formed with an operating hole vertically penetrating through the auxiliary tray.

5. The sheet supplying apparatus according to claim 4, wherein the auxiliary tray is movable between a draw-in position where the downstream side in the conveyance direction of the auxiliary tray is entered between the cover and the base tray and a draw-out position where the auxiliary tray is drawn out upstream more than the upstream end in the conveyance direction of the cover, the engage part is formed to be long in the conveyance direction, and the lifting part includes:

an upstream inclined surface formed with a down gradient from upstream to downstream in the conveyance direction;

a downstream inclined surface formed with a rising gradient from upstream to downstream in the conveyance direction; and a pressing surface connecting the upstream inclined surface with the downstream inclined surface and formed in parallel with the engage part.

6. The sheet supplying apparatus according to claim 5, wherein the other one among the cover and the auxiliary tray comprises a pair of convex parts provided projectively at downstream end of a pair of slide plates formed on the widthwise both side surfaces, and the pair of convex parts fits into a pair of fitting concave parts formed at an upstream end part of the auxiliary rail when the auxiliary tray arrives at the draw-out position.

7. An image forming apparatus comprising:

a sheet supplying apparatus provided in an apparatus body;

wherein the sheet supplying apparatus including;

a supply part provided in an apparatus body and configured to deliver a sheet;

a cover supported openably on a side surface of the apparatus body through a turning shaft and turnable between a close position covering the supply part and an open position exposing the supply part;

abase tray disposed on an upper surface of the cover disposed at the open position, composing a part of a loading surface on which the sheet is loaded, and movable in a sheet conveyance direction with respect to the cover;

an interlock mechanism configured to move the base tray downstream in the conveyance direction by interlocking with the cover turning from the close position to the open position, and configured to move the base tray upstream in the conveyance direction by interlocking with the cover turning from the open position to the close position; and an auxiliary tray provided movably in the conveyance direction through an engage part formed so as to be in slidable contact with an engaged part formed on the base tray and so as to be able to displace between a storage position where the auxiliary tray is in contact or in adjacent to the upper surface of the cover disposed at the close position and a raising position where the auxiliary tray separates from the upper surface of the cover disposed at the open position;

a lifting part provided at either one of the engage part and the engaged part comes into pressure contact with the another one among the engage part and the engaged part and displaces the auxiliary tray from the storage position to the raising position in a process of moving the base tray downstream in the conveyance direction by the interlock mechanism.

* * * * *